US007225707B2

(12) United States Patent
Knopp

(10) Patent No.: US 7,225,707 B2
(45) Date of Patent: Jun. 5, 2007

(54) TORQUE WRENCH WITH QUICK-RELEASE GEAR SET

(76) Inventor: Brian Knopp, 200 Riverside Dr., West Newton, PA (US) 15089

( * ) Notice: Subject to any disclaimer, the term of this patent is extended or adjusted under 35 U.S.C. 154(b) by 42 days.

(21) Appl. No.: 11/225,192

(22) Filed: Sep. 14, 2005

(65) Prior Publication Data

US 2007/0056408 A1 Mar. 15, 2007

(51) Int. Cl.
*B25B 17/00* (2006.01)
*B25B 17/02* (2006.01)

(52) U.S. Cl. ..... 81/57; 81/57.14; 81/57.31

(58) Field of Classification Search ..... 81/57, 81/57.13, 55, 57.11, 57.36, 56, 57.31, 57.24, 81/57.4, 58, 59.1, 57.14
See application file for complete search history.

(56) References Cited

U.S. PATENT DOCUMENTS 2,302,853 A * 11/1942 Gordon ..... 74/421 R
3,324,747 A 6/1967 Able
3,834,467 A 9/1974 Fuchs
3,970,151 A 7/1976 Workman
4,060,137 A 11/1977 Bickford et al.
4,155,278 A * 5/1979 Estok ..... 81/57.11
4,179,955 A 12/1979 Akiyoshi et al.
4,183,265 A 1/1980 Pauley
4,472,985 A 9/1984 Orikasa
4,573,370 A * 3/1986 Clemens ..... 74/337.5
4,921,362 A 5/1990 Werner
4,923,047 A * 5/1990 Fink et al. ..... 192/150
5,176,047 A * 1/1993 Bai et al. ..... 81/57.3
D339,726 S 9/1993 Bruno et al.
5,269,733 A * 12/1993 Anthony, III ..... 475/331

(Continued)

FOREIGN PATENT DOCUMENTS

JP 2298451 10/1990

OTHER PUBLICATIONS www.bmftorquewrench.com accessed on Jun. 1, 2005.
http://www.radtorque.com/model.html accessed on Jul. 11, 2005.
http://www.norbar.com/products_category.php &category_multid=4 accessed on Jul. 11, 2005.
http://www.plarad.com/Englisch/start-en.html accessed on Jul. 11, 2005.

*Primary Examiner*—Lee D. Wilson
*Assistant Examiner*—Robert Scruggs
(74) *Attorney, Agent, or Firm*—Richard C. Litman

(57) ABSTRACT

The torque wrench with quick release gear set is a system having a rotary actuator drive unit, which is attachable to a planetary drive gear set by a quick-release cylindrical adapter and collar so as to provide quick interchangeability of gear sets without the use of tools. The rotary actuator actuates the planetary gear set by means of a drive shaft connection through the quick-release cylindrical adaptor to engage a corresponding input gear drive shaft. The rotary actuator may have a pistol grip handle that rotates 360° to provide a user with an ergonomically friendly tool. The planetary gear set contains axial thrust bearings between each planet carrier to reduce friction and increase stability. The planet carriers are made of single piece construction to provide increased gear set durability. Precision radial bearings keep the planetary carriers and annulus concentric.

12 Claims, 11 Drawing Sheets

U.S. PATENT DOCUMENTS 5,624,000 A * 4/1997 Miller ..... 173/216
D388,301 S 12/1997 Steel
5,692,575 A * 12/1997 Hellstrom ..... 173/216
6,155,355 A 12/2000 Holmin
6,255,751 B1 * 7/2001 Hoffmann ..... 310/83
6,401,572 B1 * 6/2002 Provost ..... 81/57.14
6,733,414 B2 5/2004 Elger
2005/0279198 A1 * 12/2005 Kushida et al. ..... 81/469

* cited by examiner

TORQUE WRENCH WITH QUICK-RELEASE GEAR SET

BACKGROUND OF THE INVENTION

1. Field of the Invention

The present invention relates to power tools. More particularly, the present invention relates to a rotary actuated tool system having a single rotary actuator and quickly interchangeable planetary gear sets.

2. Description of the Related Art

The use of rotary operated torque wrenches is well known, particularly in the tightening large nuts on bolts or studs and in tight clearance installations not allowing for the travel of a long wrench handle. Japanese Patent No. 2-29, 845, published Dec. 10, 1990, appears to only address the issue of compound movement actuation using both linear and rotary servomotors.

Thus, a torque wrench solving the aforementioned problems is desired.

SUMMARY OF THE INVENTION

The present invention is a precision torque wrench system having a rotary actuator drive unit that is attachable to a planetary gear drive set by a quick-release cylindrical adaptor collar and a rotatable locking collar in order to provide a user-friendly attachment method.

The ring gear, i.e., annulus, is held securely and concentric to the rotary actuator, and movement in the axial direction is constrained. However, rotational movement is not constrained.

The rotary actuator may have a pistol grip handle that rotates 360°, thus providing better ergonomics for the user.

The rotary actuator actuates the planetary gear set by means of a motor drive shaft traveling and engaging a corresponding input gear drive shaft through the quick-release cylindrical adaptor collar.

The planetary gear set contains axial thrust bearings between each planet carrier to reduce friction and increase stability by providing a constraint from pivoting and to insure that the centerline of the carriers is always concentric and coincident to each other and also in relation to the centerline of the rotary actuator. The axial thrust bearings are pre-loaded by a Belleville washer that is located between the end cap and the top of the first stage carrier.

The planet carriers are made of single piece construction to provide increased gear set durability. Precision radial bearings keep the planetary carriers and annulus concentric.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
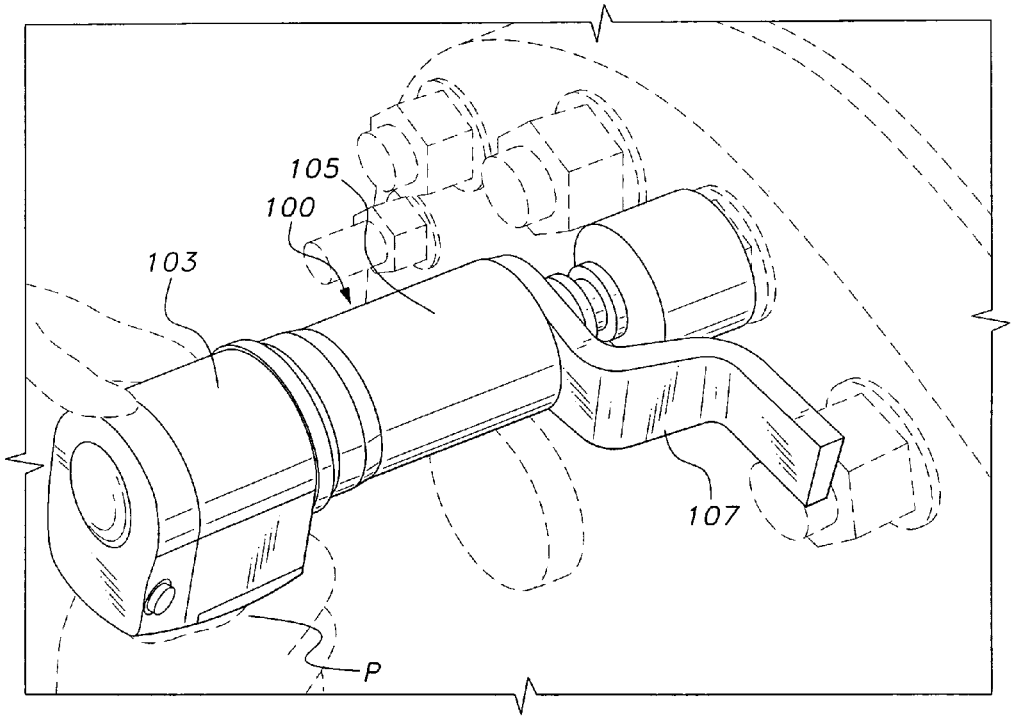
FIG. 1 is an environmental, perspective view of a torque wrench with a quick release gear set according to the present invention.

The present invention is a precision torque wrench system having a set of planetary gears driven by a rotary actuator. According to the present invention, as shown in environmental FIG. 1, the torque wrench with quick-release gear set 100 is made up of a hand held rotary actuator 103 with a pistol grip like feature P and a quickly interchangeable gear set 105 having a unitary construction reaction bar, such as bar 107. The rotary actuator may be pneumatic, hydraulic, or electric.

According to the present invention, an actuator attachment system having the quick release feature of the torque tool 103 provides for quick and easy interchangeability with a set of planetary gears for various torque outputs.

Figure 2A:
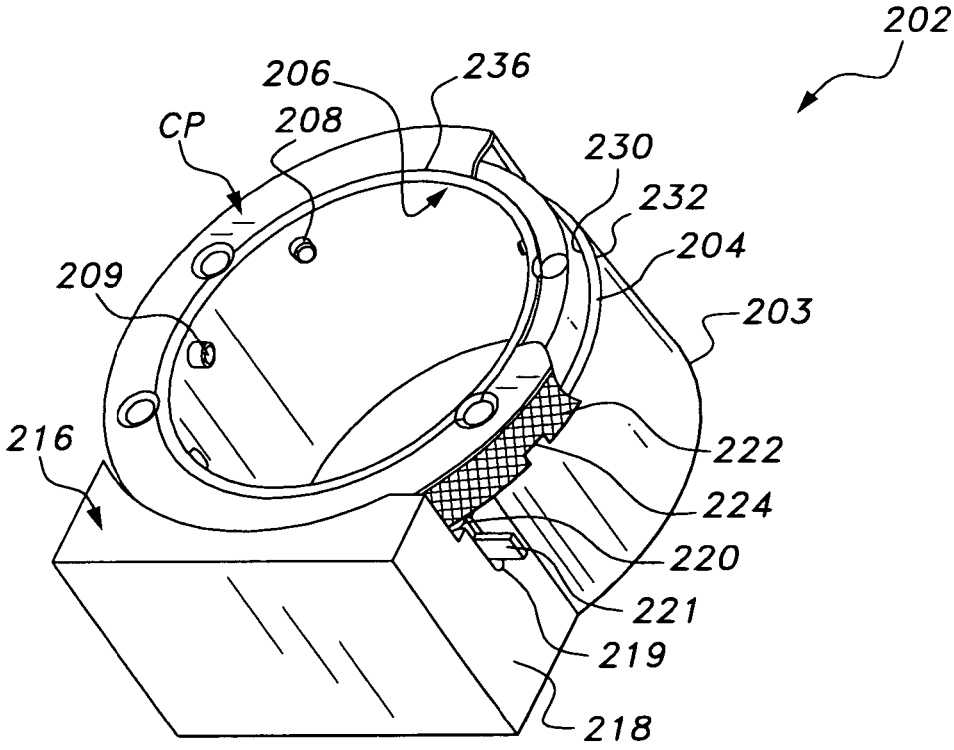
FIG. 2A is a perspective view of an actuator attachment system on a rotary actuator housing, depicting a quick change attachment flange according to the present invention.

As shown in FIGS. 1 and 2A, a structure of the rotary actuator 103 comprises a quick change attachment flange 202 that is rigidly attached to or integrally a part of housing 203 of the rotary actuator 103. The quick change attachment flange 202 includes a base 204, a base inner circumference 230, and a base outer circumference 232. A substantially cylindrical inner periphery 206 having an inner dimension 234 and an outer dimension 236 extends perpendicularly from the base inner circumference 230 of flange base 204.

Figure 2B:
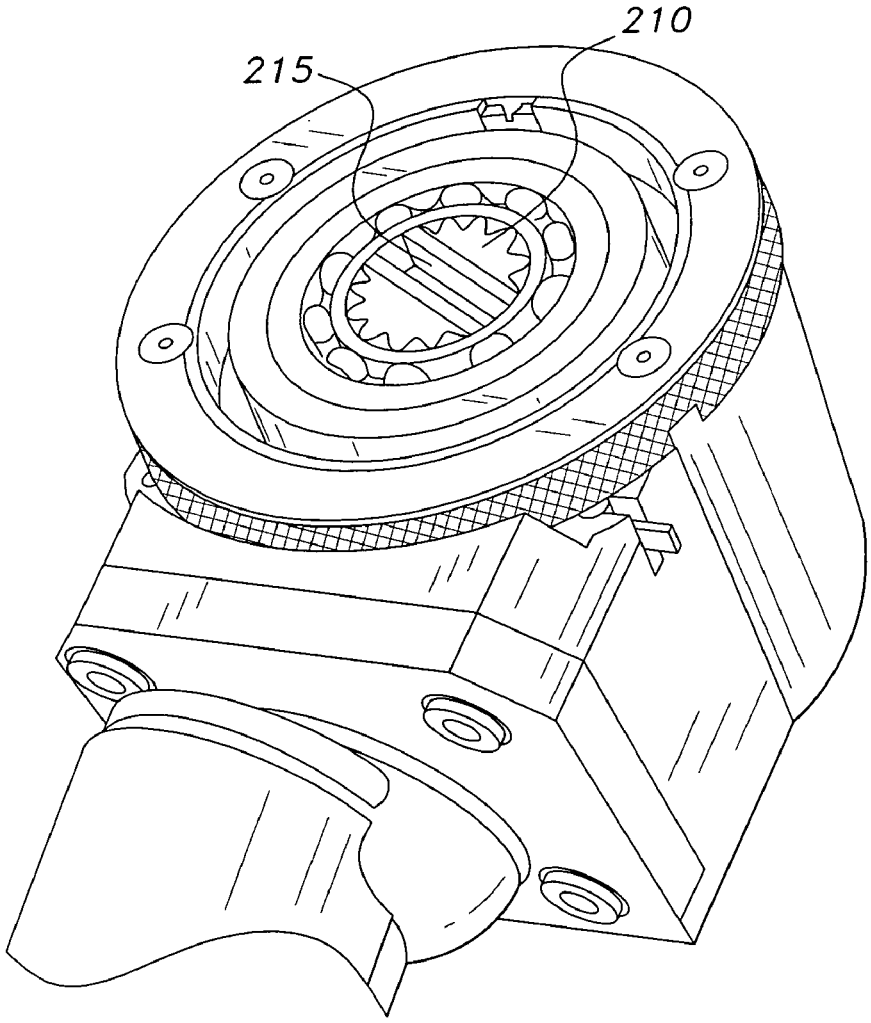
FIG. 2B is a perspective view of the actuator attachment system on the actuator housing, depicting actuator drive shaft and related components of a torque wrench with a quick release gear set according to the present invention.
Figure 2C:
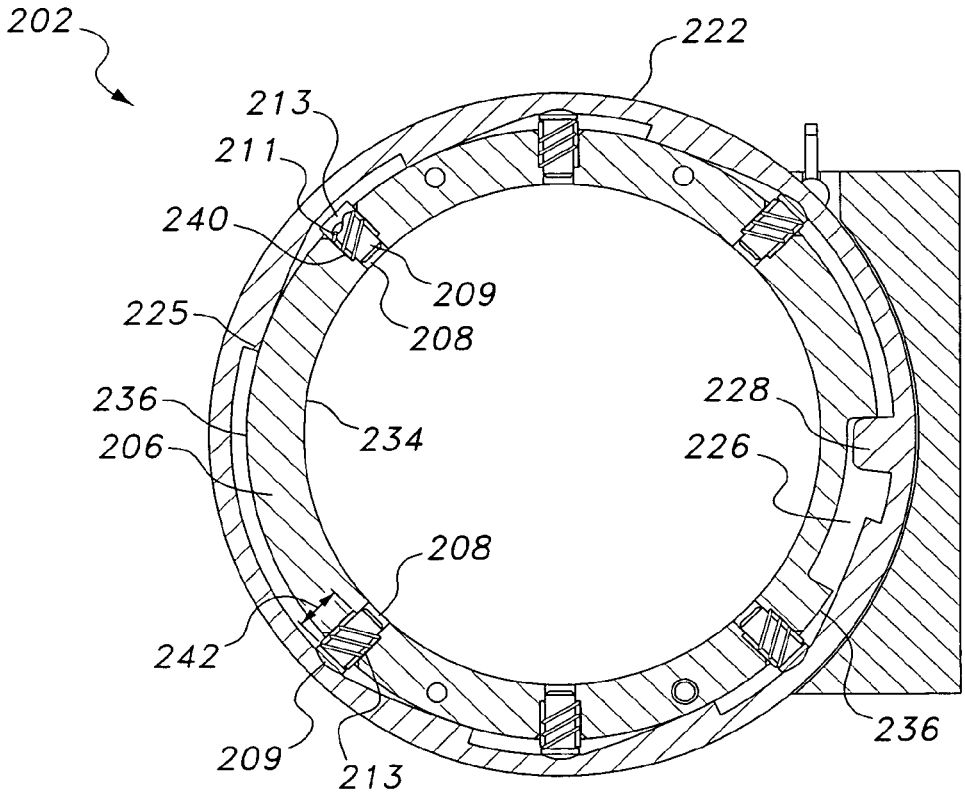
FIG. 2C is a top view of the quick change attachment flange of the present invention.

As shown in FIGS. 2A and 2C, the inner periphery 206 includes a plurality of through bores having a predetermined diameter, such as through bore 208, which are directed along radial lines converging inward to an axial center line of the inner periphery 206. Moreover, for each through bore 208, inner periphery 206 has a corresponding counter bore 213 of a predetermined depth 242, and having a greater diameter than through bore 208.

In addition, disposed within each counter bore 213 is a compression spring 211. The interface of counter bore 213 with through bore 208 creates a shoulder 240 that provides an axial support for compression spring 211.

For each compression spring 211, counter bore 213 and through bore 208 combination, an engagement pin, such as engagement pin 209 is disposed inside the compression spring 211, counter bore 213 and through bore 208 combination so that when a head of the engagement pin 209 is depressed, the engagement pin 209 penetrates corresponding bore 208.

Base 204 has a side component 218 with an elongated cavity 219 disposed perpendicular to the base outer circumference 232. Inside and supported by elongated cavity 219 is a compression spring-loaded lock pin 220 having a lock pin lever 221. Rotatable locking collar 222 rests on the base 204 and fits concentrically outside of and proximate to the inner periphery 206 of the quick change attachment flange 202. The rotatable locking collar 222 has a lock slot 224, i.e., cutout on the end of collar 222 that is resting atop base 204. The lock slot 224 engages the lock pin 220 when the rotatable locking collar 222 is rotated to a locked position.

Figure 3:
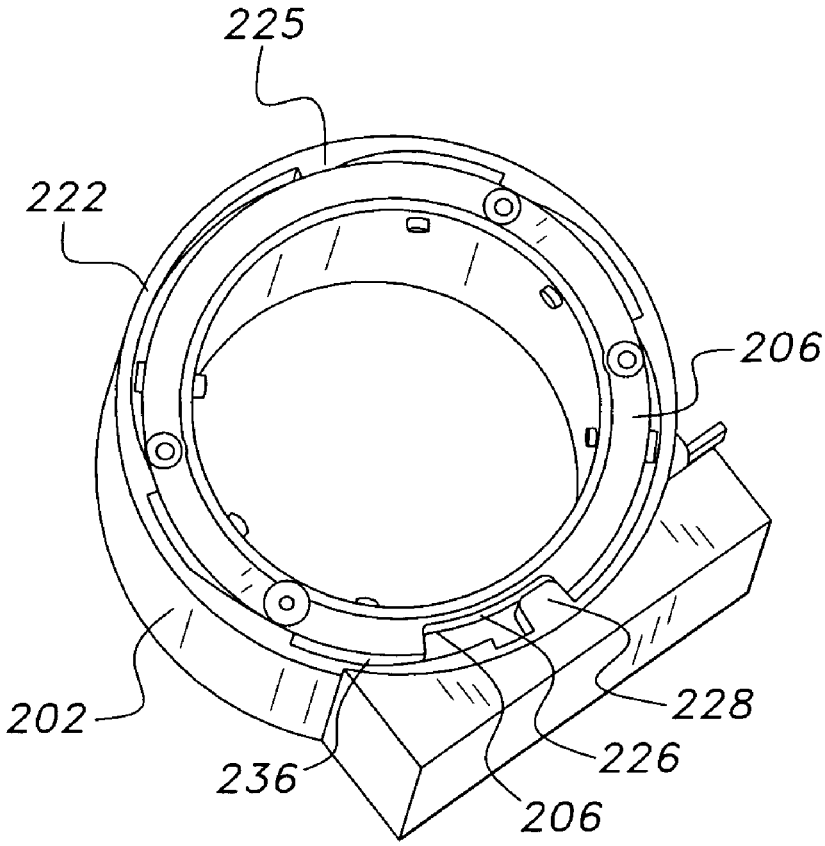
FIG. 3 is a perspective cut-away view of the actuator attachment system of a torque wrench with a quick release gear set according to the present invention, showing cam lobes on the lock collar.

Moreover, as shown in FIGS. 3 and 2C, rotatable locking collar 222 has a plurality of cam lobes, such as lobe 225 on an inner circumference of the collar 222. Referring to FIGS. 2C and 3, note that the outer dimension 236 of the inner periphery 206 has a detent, i.e. stop control 226, that defines a circumferential notch of inner periphery 206.

Collar 222 has a stop control boss 228 that fits within detent 226 for the purpose of limiting the rotational freedom of the collar 222. Thus, when the collar 222 is located to a first stop position, the cam lobes 225 depress the engagement pins 209 so that the pins penetrate the through bores 208 of the inner periphery 206. When the collar 222 is counter-rotated to the other stop position, the compression spring-loaded engagement pins 209 retract from the inner periphery bores 208. Moreover, as shown in FIG. 2A, a ring-like, substantially cylindrical protective cover plate CP being disposed over cam lobes 225 and engagement pins 209 and being attached to the quick change attachment flange 202 extends outward from the inner dimension 234 of the inner periphery 206 to an outer circumference of the rotatable locking collar 222 to provide an axial constraint on the rotatable locking collar 222 so that the locking collar 222 remains rotatably attached to the flange base 204.

Figure 4A:
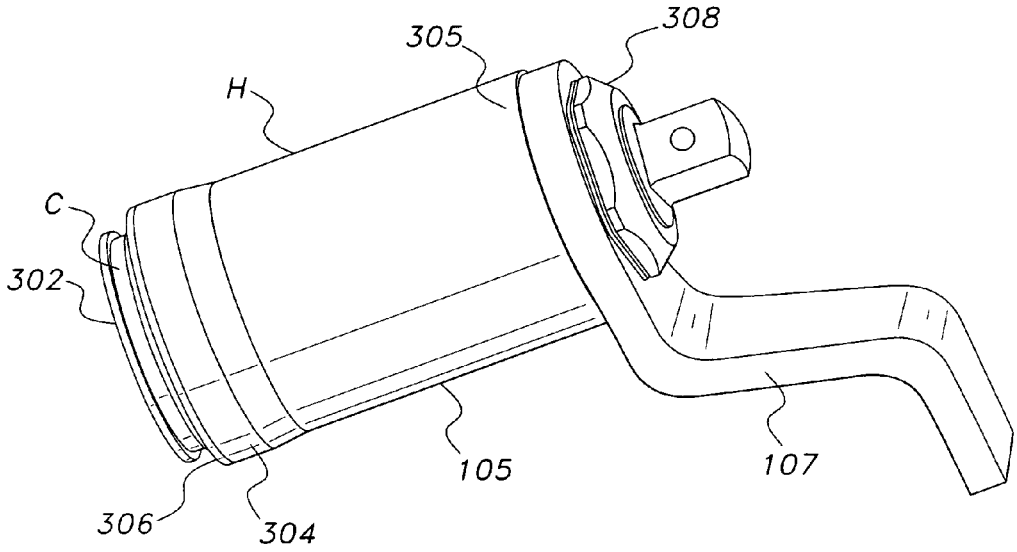
FIG. 4A is a perspective view of the gear set housing including gear set adapter collar.
Figure 4B:
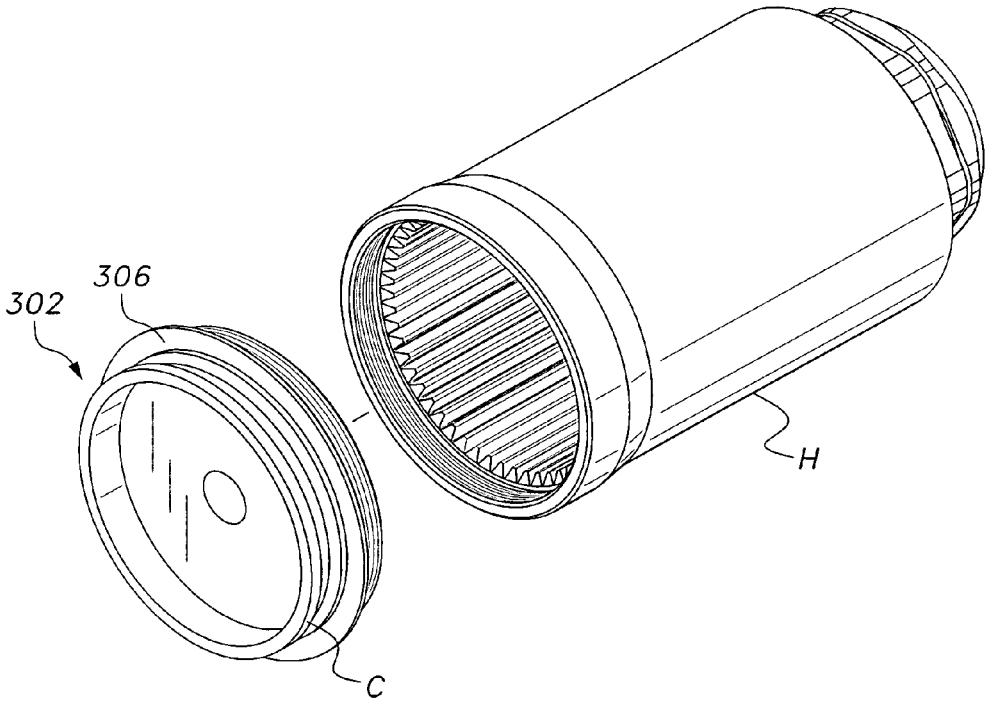
FIG. 4B is an exploded view of gear set adapter collar and gear set housing.
Figure 4C:
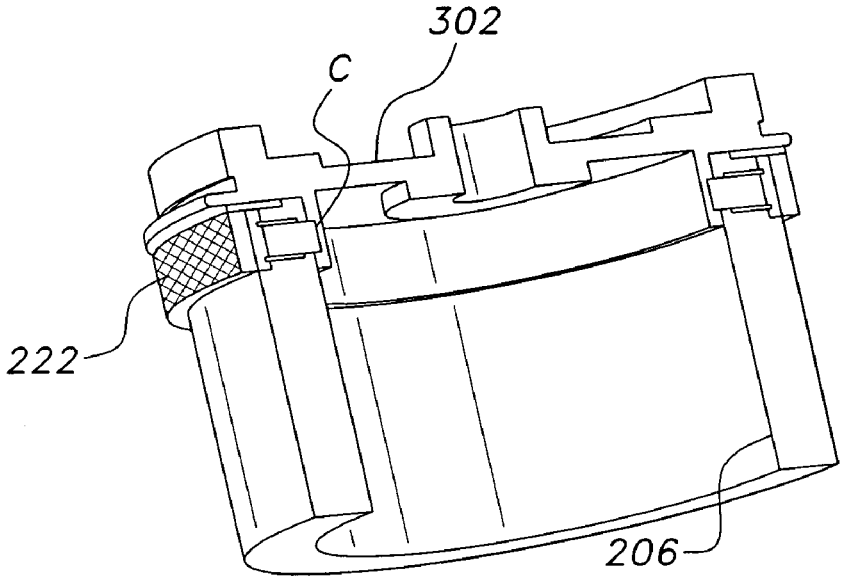
FIG. 4C is a perspective cut-away view of adapter collar attachment for the rotary actuator of a torque wrench with a quick release gear set according to the present invention.

As shown in FIG. 4A, gear set 105 comprises an adapter collar 302 that has a groove, i.e., cylindrical axial channel C around a circumference of the adapter collar 302. FIG. 4B more clearly shows how the adapter collar 302 also has a lip 306, which is disposed proximate to and above the channel C. The lip 306 has a circumference that is sufficient to cause adapter collar 302 to be supported by cover plate CP, (FIG. 2A), when the channel C of adapter collar 302 is inserted concentrically inside of and proximate to the inner periphery 206. On the other side of the lip 306 is a threaded cylindrical continuation 310 of the adapter collar 302, which threads into the gear set housing H.

The adapter collar 302 is located at an actuator attachment end 304 of the gear set 105. As shown in FIGS. 2A and 4A through 4C, when the grooved portion, i.e., channel C, of the adapter collar 302 is inserted concentrically inside of and proximate to the inner periphery 206, and rotatable collar 222 is rotated to cause cam lobes 225 to extend engagement pins 209 through bores 208, and into the channel C, an axial lock of the rotary actuator 103 to the gear set 105 is achieved, while rotational freedom between the two is maintained. Thus, the gear set housing H and annulus 502 are attached securely, axially and concentric to the rotary actuator so as to lock an axial position while allowing rotation to provide rotational movement of the rotary actuator relative to the annulus or other gears of gear set 105.

Additionally, lock slot 224 engages the lock pin 220 to insure that the axial lock of rotary actuator 103 to gear set 105 remains intact until the lock pin 220 is disengaged by depressing lock pin lever 221 so that lock pin 220 is free and clear of lock slot 224. When the lock pin 220 is disengaged, a counter-rotation of rotatable collar 222 retracts the engagement pins 209 and allows the gear set 105 to be detached from the rotary actuator 103.

Figure 5:
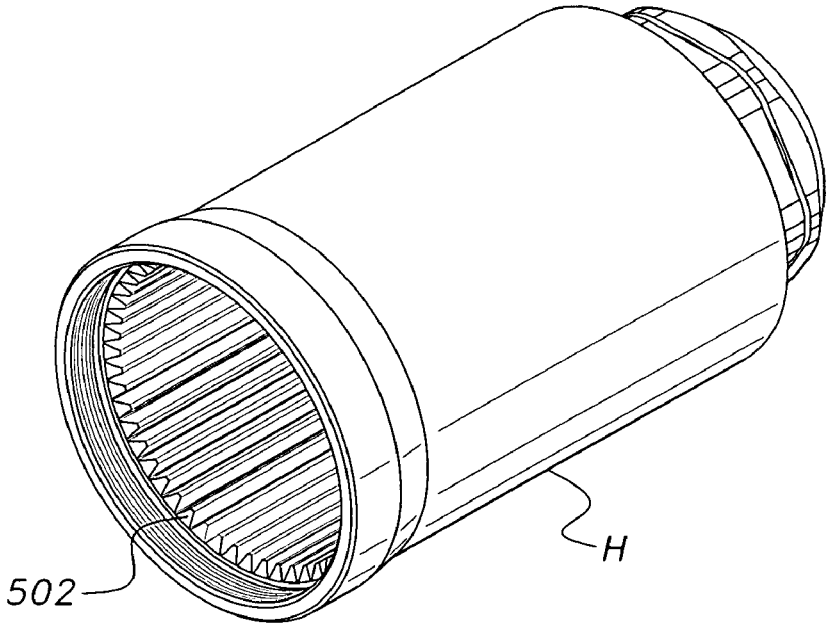
FIG. 5 is a perspective view of the annulus and gear set housing of a torque wrench with a quick release gear set according to the present invention.

As shown in FIG. 4A, reaction bar 107 attaches to a workpiece engagement end 305 of gear set 105, whereby the internal hexagonal shape of 107 fits over the male hexagonal shape of 305. Reaction bar 105 is held in place and constrained axially with either a metallic snap ring, elastomeric O-ring, or a threaded nut. During workpiece engagement, the reaction bar 107 holds an annulus 502, i.e., ring gear, (refer to FIG. 5), of the gear set 105 stationary during tool operation in order to provide rotation of a sun gear such as gear 712, (FIG. 7), thus permitting transmission of torque from the rotary actuator to an output shaft, such as output shaft 713 of the planetary gear set.

Figure 6:
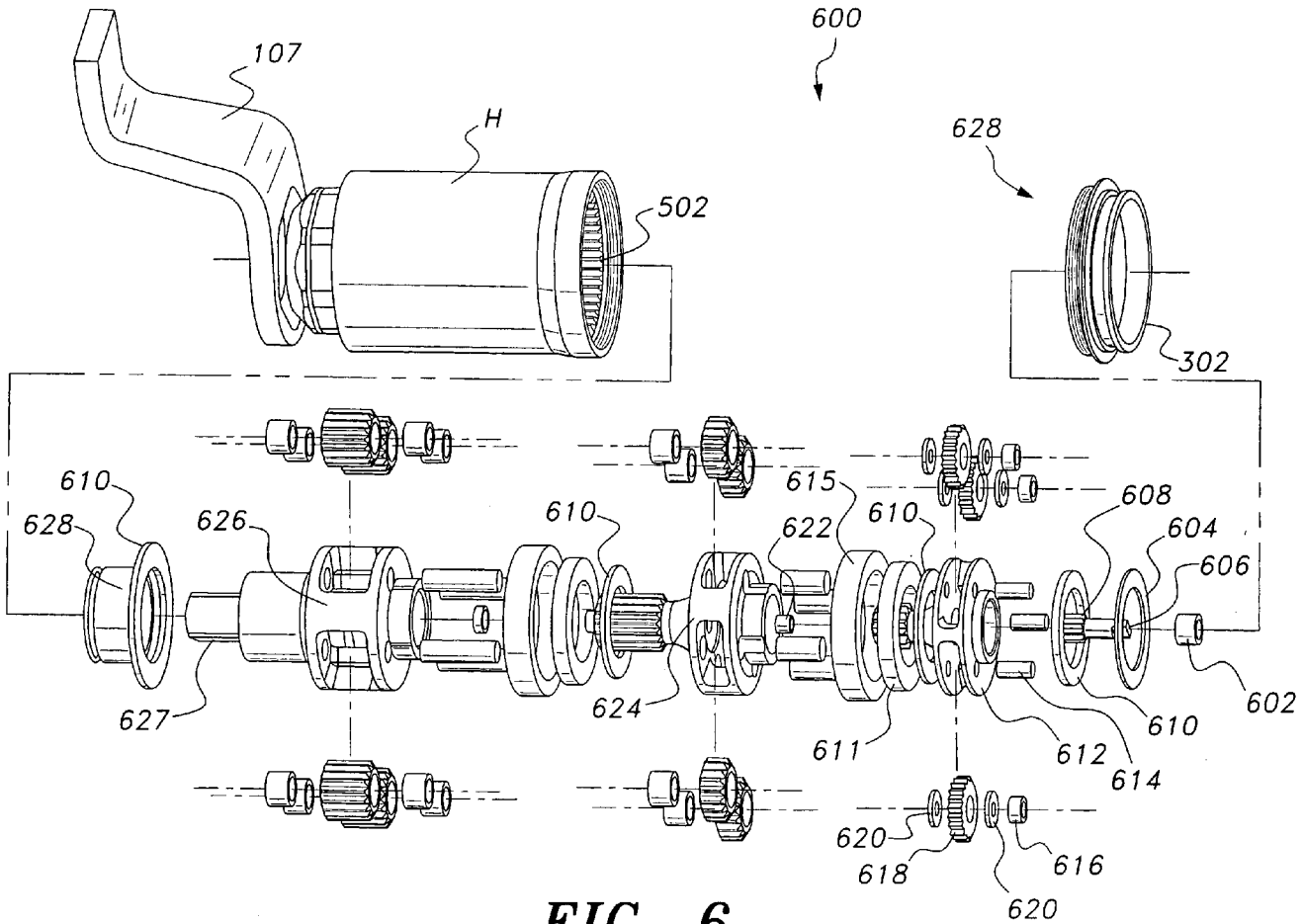
FIG. 6 is an exploded perspective view of the gear set assembly of a torque wrench with a quick release gear set according to the present invention.

Referring to FIGS. 2B and 6, note that rotary actuator drive shaft 210 comprises a radial slot 215 that, in the embodiment shown, traverses the entire diameter of the drive shaft 210. However, radial slot 215 may traverse a pre-determined portion of the drive shaft 210 sufficient to transmit torque from the drive shaft 210. As shown in FIG. 6, first stage input gear 608 of gear set 600, comprises a first stage input gear shaft 605, and a drive rotary actuator engagement boss 606, which is an oval-like protrusion of first stage input gear shaft 605.

As shown, the drive rotary actuator engagement boss freely protrudes through the central opening of adapter collar 302. According to the present invention, the drive rotary actuator engagement boss 606 fits into the radial slot 215 of rotary actuator drive shaft 210 to provide mechanical coupling for torque transmission of the rotary actuator 103 to the gear set 600.

Furthermore, a radial thrust bearing 602 fits over first stage input gear shaft 605. Within the gear set housing H, and tightly sandwiched between the adapter collar 302, and an input side of a first planet carrier 612 is a compression member, e.g., in the embodiment shown, the compression member is a Belleville washer 604. Note that gear set side 628 of adapter collar 302 functions as a gear set end cap when adapter collar 302 is threaded into gear set housing H.

Optionally, the configuration of the Belleville washer 604 and the first stage planet carrier 612 includes an axial thrust bearing 610 sandwiched between the Belleville washer and the first stage planet carrier 612, where the axial thrust bearing 610 is radially held into place by being placed over a radial bearing hub 706, (see FIG. 7), of the first planet carrier 61 2. First planet carrier 612 and the entire gear set 600 are axially preloaded by the Belleville washer 604 to reduce axial play and thus mitigate gear set wear and tear.

Preferably, in addition to first planet carrier 612, at least one additional planet carrier axially in line with the first planet carrier 612 is configured to receive torque from the output of first planet carrier 612. The additional planet carrier, such as second planet carrier 624 has an output side comprising an axial thrust bearing hub, like hub 708, and an axial thrust bearing 610 attached to the axial thrust bearing hub, such as hub 708.

Figure 7:
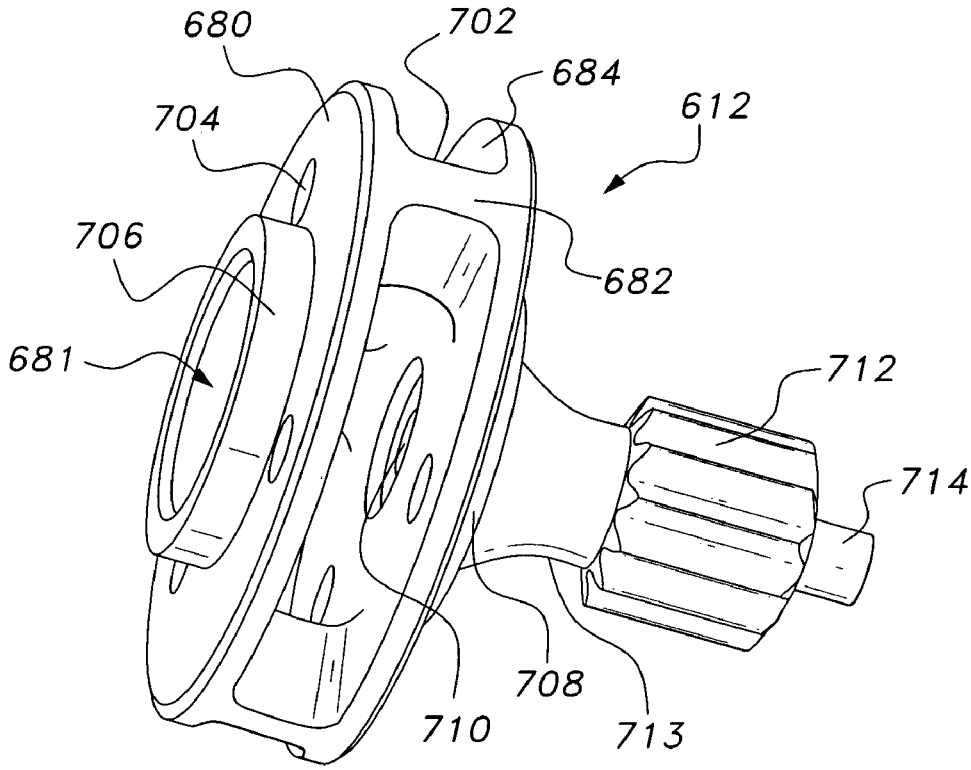
FIG. 7 is a perspective view of the first planet carrier of a torque wrench with a quick release gear set according to the present invention.

All planet carriers of the gear set 600, including first planet carrier 612, are of a unitary, i.e., one-piece construction. Referring to FIGS. 6 and 7, it is shown that the present invention provides for a unitary construction of planet carrier 612 comprising a first circular flange shaped member 680 having a radial bearing hub 706 for receiving a radial bearing, such as radial bearing 622.

Furthermore, the first circular flange member 680 has an axial opening 681 for receiving a previous stage sun gear or actuator drive gear such as gear 608. As shown, the radial bearing hub 706 is axially directed towards a previous stage of the gear set 600. The first circular flanged shape member 680 is integrally, i.e., unitarily connected by a plurality of spacing members, such as spacing member 682 to a second circular flange shaped member 684.

The second circular flange shaped member 684 forms an axial thrust bearing hub 708, which is directed axially towards a following stage of the gear set. An output shaft 713, including a sun gear 712 and sun gear axle hub 714 is integrally connected axially to the second circular flange shaped member 684, as shown in FIG. 7. Second circular flange shaped member 684 also has an axially positioned C-bore for receiving a previous stage sun gear such as sun gear 712, and sun gear axle hub, such as sun gear axle hub 714. A plurality of planet gear pockets, such as planet gear pocket 702 are formed by the integral, unitary connections between the plurality of spacing members, such as spacing member 682, and the first and second circular flange shaped members 680, 684.

As shown, planet gear axle borings, such as planet gear axle boring 704, are made in the first circular flange shaped member 680 and the second circular flange shaped member 684 corresponding to and centered about each of the planet gear pockets, such as planet gear pocket 702, for holding the plurality of planet gears of each planet carrier, such as first planet carrier 612, second planet carrier 624 and third planet carrier 626.

The unitary construction of the planet carriers, such as planet carrier 612, further reduces wear and tear of the gear set by limiting both radial and axial play. Additionally, the unitary construction of carrier 612 provides for a more durable tool, eliminating the need for several individual bolted on carrier components. Planet gears 618 fit in the planet gear pockets 702 of planet carriers, such as planet carrier 612, and may optionally be axially sandwiched by planet gear washers 620.

Additionally, the planet gears 618 are supported radially by precision radial bearings, such as bearing 616. Planet gear axle 614 is inserted through the planet axle boring 704 to support the assembly of washers 620, planet gear 618 and bearing 616 within the planet gear pocket 702. According to the present invention, for each planet carrier 612, the planet gear axles, such as planet gear axle 614, are held in place axially by the two axial thrust bearings 610, as shown in FIG. 6.

The present invention provides for a last stage of the planet carriers, such as, in the embodiment shown, planet carrier 626, having a workpiece engagement shaft 627 in lieu of planet gear 712. In the embodiment shown, workpiece engagement shaft 627 has a square configuration; however it should be understood that workpiece engagement shaft 627 may have a variety of structural configurations including a spline, hex, square, or any other configuration suitable to engage the workpiece at hand.

To maintain a centerline of the planet carriers, such as carrier 612, each carrier is fitted with a precision radial thrust bearing, such as planet gear radial bearing 611 over planet gear radial bearing hub 706. Fitting over and concentric to radial bearing 611 is radial bearing sleeve 615. The precision radial bearings, such as radial bearing 611, keep the annulus and planetary carriers concentric. The output stage of the planet carrier is fitted with an axial thrust bearing, such as axial thrust bearing 610, over axial thrust bearing hub 708 to reduce friction and increase stability of the gear set 105.

The torque output of the present invention is directly proportional to an input air pressure and flow. Regulation of the air pressure introduced into an actuator having a pneumatic rotor controls the torque output of the tool. A torque wrench of the present invention is calibrated on a certified test device to produce a cross reference chart for determining a required input air pressure for a desired torque output.

It is to be understood that the present invention is not limited to the embodiments described above, but encompasses any and all embodiments within the scope of the following claims.

I claim:

1. A rotary torque wrench comprising:

a rotary actuator having a drive shaft and a quick change attachment flange with an opening provided for the drive shaft of the rotary actuator;

a planetary gear set attached to an adapter collar having an opening for a first stage input gear shaft of the planetary gear set and a cylindrical axial channel disposed radially outward from the opening;

means for quickly engaging and disengaging the adapter collar to the quick change attachment flange to provide an axial locking attachment of the gear set to the rotary actuator without the use of tools, while maintaining rotational freedom between the gear set and the rotary actuator;

wherein the planetary gear set removably attaches to the rotary actuator, creating a mechanical connection of the rotary actuator drive shaft to the first stage input gear shaft of the gear set for torque transmission of the rotary actuator to the gear set;

wherein the quick change attachment flange includes a base having a base inner circumference, a base outer circumference, and an inner periphery extending from the base inner circumference, the inner periphery having a plurality of through bores defined therein extending radially and converging inward to an axial center line of the inner periphery, the inner periphery having for each through bore a corresponding, concentric counter bore of a predetermined depth and greater diameter than the through bore;

a compression spring disposed within each counter bore, each compression spring being supported by a shoulder formed by the corresponding counter bore and through bore;

an engagement pin disposed inside the combination of the compression spring, counter bore and through bore;

a rotatable locking collar having a plurality of cam lobes disposed on an inner circumference of the rotatable locking collar, the rotatable locking collar resting atop the base of the quick change attachment flange and fitting concentrically outside and proximate to the inner periphery; and wherein a removable attachment of the gear set to the actuator is obtained by rotating the rotatable locking collar, thereby causing the cam lobes to push the compression spring-loaded engagement pins to penetrate the plurality of through bores and into the cylindrical axial channel of the adapter collar when the adapter collar has been inserted concentrically inside of and proximate to the inner periphery.

2. The rotary torque wrench according to claim 1, wherein the inner periphery further comprises a stop control detent defining a notch in the circumference of the inner periphery, the notch being adaptable for a fitting of the rotatable locking collar.

3. The rotary torque wrench according to claim 2, wherein the rotatable locking collar has a stop control boss that fits within the detent for the purpose of limiting the rotational freedom of the rotatable locking collar to two stop positions.

4. The rotary torque wrench according to claim 3, wherein a first of the two stop positions locates the rotatable locking collar in a position that extends the engagement pins into the cylindrical axial channel of the gear set adapter collar.

5. The rotary torque wrench according to claim 3, wherein a second of the two stop positions locates the rotatable locking collar in a position that retracts the engagement pins from the cylindrical axial channel of the gear set adapter collar.

6. The rotary torque wrench according to claim 1, wherein the base of the quick change attachment flange has a side component with an elongated cavity, the wrench further comprising a compression spring-loaded lock pin with a lock pin lever supported by the elongated cavity, the lock pin abutting the rotatable locking collar, the rotatable locking collar having a lock slot cutout on the end of the rotatable locking collar that is resting atop the base;

wherein the lock slot engages the lock pin when the rotatable locking collar is rotated to the position securing the axial lock of the rotary actuator to the gear set until the lock pin lever is depressed.

7. The rotary torque wrench according to claim 1, wherein the planetary gear set further includes at least one planet carrier of unitary construction having:

a first circular flange shaped member having a radial bearing hub for receiving a radial bearing and an axial opening for receiving a previous stage sun gear;

the radial bearing hub being axially directed towards a previous stage of the gear set;

the first circular flanged shape member being integrally connected by a plurality of spacing members to a second circular flange shaped member;

the second circular flange shaped member having an axial thrust bearing hub for receiving an axial thrust bearing;

the axial thrust bearing hub being directed axially towards a following stage of the gear set;

an output shaft including a sun gear and a sun gear axle hub integrally connected axially to the second circular flange shaped member;

the second circular flange shaped member further having an axially positioned C-bore for receiving a previous stage sun gear and sun gear axle hub;

the planet carrier further having a plurality of planet pockets being formed by the connections between the spacing members and the first and second circular flange shaped members; and planet gear axle borings in the first and second circular flange shaped members corresponding to and centered about each of the planet pockets for holding a plurality of planet gears.

8. The rotary torque wrench according to claim 1, wherein the planetary gear set has a Belleville washer sandwiched between the adapter collar and a first planet carrier, whereby the axial thrust bearing of the first planet carrier and any subsequent axial thrust bearing of any subsequent planet carrier are pre-loaded by the Belleville washer.

9. The rotary torque wrench according to claim 1, wherein the planetary gear set has at least one additional planet carrier axially in line with the first planet carrier; the at least one additional planet carrier having an output side comprising an axial thrust bearing hub; and, an axial thrust bearing attached to the axial thrust bearing hub of the at least one additional planet carrier.

10. The rotary torque wrench according to claim 1, wherein a reaction bar attaches to a workpiece engagement end of the planetary gear set and is secured to an annulus of the planetary gear set by a metallic snap ring.

11. The rotary torque wrench according to claim 1, wherein the mechanical connection of the rotary actuator drive shaft to the first stage input gear shaft of the gear set further comprises:

the rotary actuator drive shaft having a radial slot that traverses a pre-determined portion of the drive shaft;

the first stage input gear shaft of the gear set having a rotary actuator drive engagement boss;

wherein the rotary actuator engagement boss fits into the radial slot of the rotary actuator drive shaft thereby providing the mechanical coupling for the torque transmission of the rotary actuator to the gear set.

12. The rotary torque wrench according to claim 1, wherein each of the plurality of planet gears is rotatably attached to the planet carrier in a corresponding of the planet gear pockets, through a corresponding of the planet gear axle borings by a planet gear axle having a precision radial bearing, thereby limiting radial play in the rotating planet gear.

* * * * *